United States Patent [19]

Haddock

[11] Patent Number: 5,046,728

[45] Date of Patent: Sep. 10, 1991

[54] CHALK HOLDER AND SCUFF GAUGING DEVICE

[76] Inventor: John Haddock, RR #1, 4th Concession, Uxbridge, Ontario, L0C 1K0, Canada

[21] Appl. No.: 598,520

[22] Filed: Oct. 16, 1990

[51] Int. Cl.[5] ..... A63B 71/00

[52] U.S. Cl. ..... 273/18

[58] Field of Search ..... 273/14, 17, 18, 19, 273/20, 21, 344, 345, 346, 347

[56] References Cited

U.S. PATENT DOCUMENTS

| | | | |
|---|---|---|---|
| 2,459,087 | 1/1949 | Miller | 273/20 |
| 4,055,343 | 10/1977 | Stuart | 273/345 |
| 4,305,587 | 12/1981 | O'Crady | 273/345 |
| 4,953,770 | 9/1990 | Bond | 273/18 |

FOREIGN PATENT DOCUMENTS

| | | | |
|---|---|---|---|
| 802962 | 9/1936 | France | 273/17 |
| 200657 | 7/1923 | United Kingdom | 273/17 |

*Primary Examiner*—Theatrice Brown

*Attorney, Agent, or Firm*—Jeffrey T. Imai; Arne I. Fors

[57] ABSTRACT

A chalking and scuffing device for use on a pool or billiard cue is described. The device includes in combination a plate member having a serrated scuffing surface on a portion of one face and a chalk holder having a magnetic base for detachably securing to the plate member. The device also includes a means for securing it onto the clothing of the user.

5 Claims, 1 Drawing Sheet

CHALK HOLDER AND SCUFF GAUGING DEVICE

This invention relates to a device for the chalking and scuffing for a pool or billiard cue or the like. More particularly, it relates to a device which includes in combination a means for scuffing the tip of a pool or billiard cue as well as maintaining a means for securing a chalk holder for chalking said cue.

The precision and control needed for effectively playing pool, billiards or the like, requires that the cue used for hitting the ball have a somewhat rounded impacting point of predetermined dimension. The cue tip located at the end of a shock absorbing ferrule is filed or scuffed against an abrasive or serrated surface. After scuffing and before impacting with the billiard ball the cue tip is usually chalked by using a block of billiard chalk maintained at the game site for that purpose.

Scuffing and chalking must be done numerous times throughout a billiard game. Play is delayed as the player must stop and travel around the table to reach the respective chalk and scuffing devices.

The need for a personal chalk holder and scuffing device that a player can carry with him as he works around the table, is one that has long been recognized. While the chalk cube as well as certain types of scuffing devices presently available could be retained by the player in separate pockets, the applicant has overcome this problem by a simpler and more convenient arrangement.

The applicant has invented a device whereby the chalking block and scuffing device can be retained as a unit for easy accessibility and the unit can be clipped onto the players belt or pocket so that both functioning units are readily available at all times.

It is therefore an object of one aspect of this invention to provide a device having chalking and scuffing components releasably connected to each other as an integral unit.

It is an object of another aspect of this invention to provide a scuffing unit for releasable attachment to the clothing of the player which also includes a magnetic means for securing the chalk holder.

These and other objects are achieved by means of a chalking and scuffing device comprising in combination:

a) a plate member having a serrated scuffing surface on at least a portion of one face thereof;
b) means on said plate for seuring said plate to user; and
c) a chalk holder having a bottom wall and side walls, an opening between said side walls for receiving and holding a block of billiard chalk, and a means for releasably securing said chalk holder onto said plate.

In the Drawings

Figure 1:
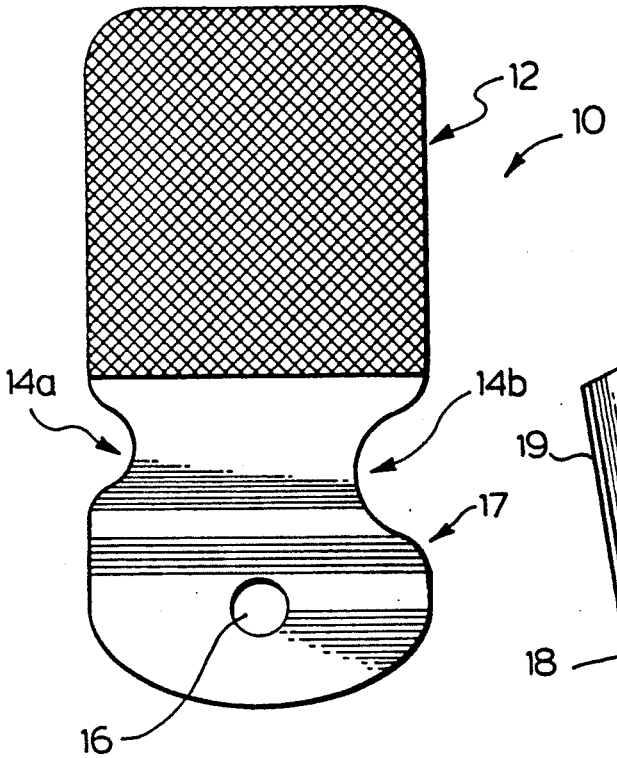
FIG. 1 is a plan view of the plate member portion of the present invention.

Plate member shown generally as 10 in FIG. 1, includes a serrated surface 12 at one end. As an optional feature, the plate can include tip gauges 14*a* and 14*b* for gauging the contour of the billiard cue tip after it has been subject to scuffing on the serrated surface 12. The dimensions of these gauges are such as to conform to standard contours as accepted in the game of pool or billiards. For example, tip gauge 14*a* may be specifically contoured for gauging the proper dimension of a 9 mm cue tip and, tip gauge 14*b* contoured for gauging a 14 mm tip.

As a further feature, the lower end of plate member 10 can include a hole 16 for looping a chain or string therethrough and thereby securing the plate onto a key ring or belt of the user. The lower base of plate number 10 can also include a ferrule gauge 17 above hole 16. This consists of a series of horizontal die cut lines to measure the dimensions of the ferrule of a billiard cue which is to be scuffed and chalked. In one embodiment, plate member 10 may have a serie sof six such lines so spaced as to provide gauge dimensions of from 9 mm to 14 mm.

Figure 2:
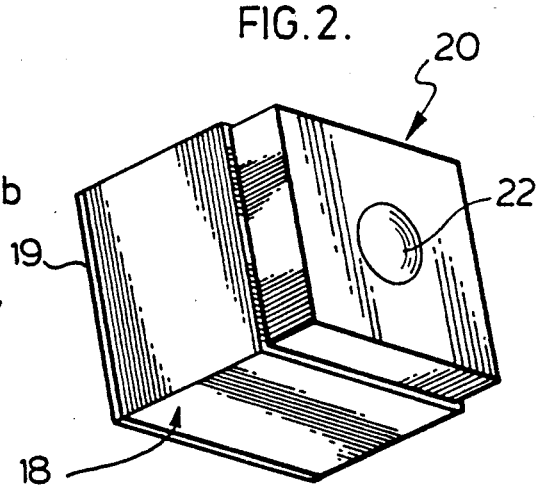
FIG. 2 is a perspective view of the chalk holder with a block of billiard chalk positioned therein.

FIG. 2 shows the chalk holder 18, which is to be used in combination with plate 10. Chalk holder 18 includes rectangular side walls for receiving and holding a block of billiard chalk 20 within its walls. Chalk 20 is in block form of the type conventionally used by pool or billiard players and usually includes the center indentation 22 in the chalk surface for the convenient chalking of the billiard cue tip.

Figure 3:
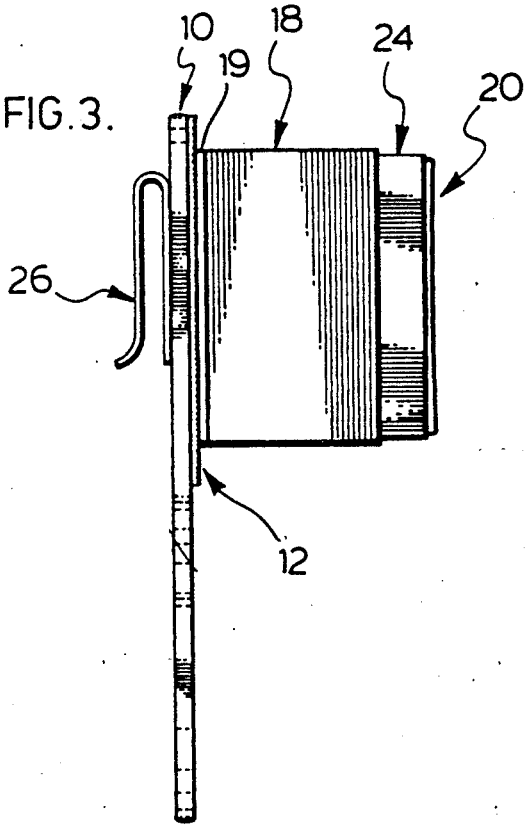
FIG. 3 is a side view of the device of the present invention showing the chalkholder positioned on the plate member.

FIG. 3 is a side view of the chalking and scuffing device of the present invention showing the chalk holder 18 positioned on plate member 10. The bottom wall of chalk holder 18 includes a magnet (not shown) for attaching the holder onto the metallic plate 10. This connection can be made onto the serrated surface area 12 or elsewhere on the plate.

The block of chalk is shown positioned within the wall of chalk holder 18 with its usual paper wrapper 24 snugly inserted within the cavity defined by the walls of the chalk holder.

A clip 26 is shown mounted on the side of plate member 10 opposite to the serrated surface area 12 for clipping the plate and accompanying chalk holder onto a belt or pocket of the user. Thus, the device can be carried by the user either by clipping onto an article of clothing or extending from a chain looped through hole 16.

Figure 4:
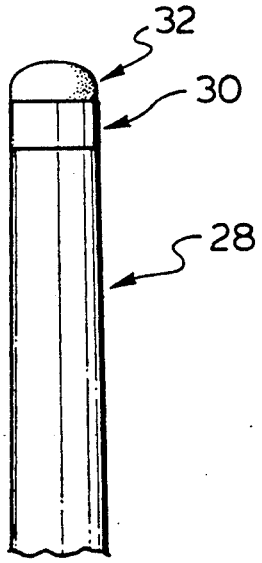
FIG. 4 is a plan view of a section of the leading end of a conventional billiard cue.

When the user wishes to chalk the billiard cue during a game, he releases the device from its clip connection or extends it from a chain and scuffs the cue tip to the required dome shaped dimensions. This tip is usually contoured in the manner shown in tip 32 of FIG. 4. The tip is positioned at the end of a shock absorbing ferrule 30 located at the end of billiard cue shaft 28. Thus, the user can scuff his billiard cue without travelling from the location of this shot. Similarly the scuffed tip is then chalked by the block of chalk mounted on the device itself.

While a preferred embodiment of the invention has been particularly described, it must be appreciated that minor modifications and additions can be made to the device without departing from the scope of the invention as set out in the above disclosure or as recited in the appended claims.

I claim:

1. A chalking and scuffing device for use with a billiard cue comprising in combination:

a) a plate member having a face, a portion of which is of the magnetizable metal, a serrated scuffing surface on a least a portion of said face and a gauge for measuring the tip contour of a billiard cue on at least one edge of said plate;

b) means on said plate for securing said plate to the user thereof;

c) a chalk holder having a bottom wall and side walls, an opening between said side walls for receiving and holding a block of billiard chalk, and a means for releasably securing said chalk holder onto said plate, comprising a magnet on the bottom wall of said chalk holder for releasably engaging said magnetizable metal.

2. A device as claimed in claim 1 wherein said means for securing said plate to the user thereof includes a hole in the second area of the plate for looping a securing line therethrough.

3. A device as claimed in claim 1 wherein said means for securing said plate to the user thereof includes a clip on the side of said plate opposite said serrated scuffing surface adapted for clipping over the edge of an article of clothing.

4. A chalking and scuffing device for use on a billiard cue comprising in combination:

a) a metallic plate member including a first area having a serrated scuffing surface on at least a portion of one face thereof;

b) a second area on said plate member including at least one tip gauge for gauging the tip contour of a billiard cue;

c) a first securing means on said plate for securing said plate to said user comprising a clip on the side of said plate opposite said serrated scuffing surface, said clip adapted for engaging the edge of an article of clothing, and a second securing means on said plate including a hole in the second area of the plate for looping a securing line therethrough;

d) a chalk holder having a bottom wall and side walls, and opening between said side walls for receiving and holding a block of billiard chalk, and a magnet on said bottom wall for releasably securing said chalk holder onto the serrated surface area of said plate member.

5. A device a claimed in claim 4 which further includes a ferrule gauge comprising a plurality of lines extending across the second area of said plate member, said lines being spaced apart a predetermined distance for gauging the dimensions of the ferrule of a billiard cue.

* * * * *